US005718466A

United States Patent [19]

Weinerman et al.

[11] Patent Number: 5,718,466

[45] Date of Patent: Feb. 17, 1998

[54] RACKING RESISTANT DOOR CONTROL MECHANISM AND METHOD OF FABRICATION

[75] Inventors: Lee S. Weinerman, Medina; James L. Hollingsworth, Middleburg Heights; Fredrick L. Putzier, Columbia Station; Scott A. Arthurs, Brunswick; Robert D. Dinallo, Parma, all of Ohio

[73] Assignee: The Eastern Company, Cleveland, Ohio

[21] Appl. No.: 556,607

[22] Filed: Nov. 13, 1995

[51] Int. Cl.[6] ..... E05C 3/14

[52] U.S. Cl. ..... 292/218; 292/241; 292/DIG. 32; 384/432; 384/624; 384/909

[58] Field of Search ..... 292/218, 241, 292/DIG. 32; 384/283, 909, 432, 624, 434, 442, 428

[56] References Cited

U.S. PATENT DOCUMENTS

| | | | |
|---|---|---|---|
| D. 228,169 | 8/1973 | Morris | D8/137 |
| D. 228,170 | 8/1973 | Morris | D8/137 |
| D. 242,428 | 11/1976 | Morris | D8/137 |
| D. 247,546 | 3/1978 | Shaw et al. | D8/344 |
| D. 247,871 | 5/1978 | Shaw et al. | D8/343 |
| D. 249,634 | 9/1978 | Pastva | D8/346 |
| D. 250,247 | 11/1978 | Pastva | D8/339 |
| D. 294,452 | 3/1988 | Bakula | D8/330 |
| D. 351,987 | 11/1994 | Lee | D8/343 |
| D. 353,318 | 12/1994 | Lee | D8/343 |
| 1,952,112 | 3/1934 | Bartsch | 292/218 |
| 1,988,585 | 1/1935 | Dath | 20/21 |
| 2,301,444 | 11/1942 | Olander | 292/218 |

(List continued on next page.)

OTHER PUBLICATIONS

Eberhard Manufacturing Co., Division of The Eastern Company, "Eberhard Industrial & Vehicular Hardware" Catalog #106, Jan. 1994, pp. 120–140, Cleveland, OH 44136.

ZRC Products Co, "The 13 Questions Most Asked About ZRC", 4 Page Brochure, (Date Unknown, but believed to be prior to Nov. of 1995), Quincy, MA 02170.

ZRC Products Co, "Corrosion Control—Cold Galvanizing Compounds," 4 Page Brochure, (Date Unknown, but believed to be 1992), Quincy, MA 02170.

ZRC Products Co, "Your Future is Bright, With Galvilite," 2 Page Brochure, (Date Unknown, but believed to be prior to Nov. of 1995), Quincy, MA 02170.

E.I. DuPont de Nemours & Co., "Design Handbook For DuPont Engineering Plastics—Delrin"—p. 5—(Date Unknown, but believed to be Nov. of 1995., Wilmington, DE 19898.

*Primary Examiner*—Rodney M. Lindsey
*Attorney, Agent, or Firm*—David A. Burge

[57] ABSTRACT

A racking resistant door control mechanism for securing a pivoted door employs an elongate lock rod that extends the height of the door and is journaled for pivotal movement by bearing assemblies having steel covers that enclose plastic bearing liners. The lock rod has upper and lower cam-type latch members welded to its opposite ends for engaging keeper members carried by upper and lower parts of a door frame for holding the door closed. The lock rod extends through and is welded to a steel sleeve at a location spaced a short distance upwardly from the lower latch member. If the lock rod is formed from two elongate elements instead of one, the sleeve is welded to both to aid in forming a connection therebetween. Racking resistance is provided by locating the sleeve and the bearing assemblies such that the steel covers of the bearing assemblies are held in engagement with the latch members and with opposite ends of the sleeve. The various metal components of the door control mechanism are protectively coated before being assembled and before being welded, with rigid assembly connections being formed by normally hidden welds of relatively small size that burn through the protective coatings and are, in turn, protectively coated by a zinc rich, polymer containing film applied as a "touch-up" spray.

34 Claims, 5 Drawing Sheets

U.S. PATENT DOCUMENTS

| | | | |
|---|---|---|---|
| 2,442,031 | 5/1948 | Beauchamp | 20/23 |
| 2,451,537 | 10/1948 | Dath | 292/218 |
| 2,505,945 | 5/1950 | Dath | 292/218 |
| 2,538,203 | 1/1951 | Lehman | 292/218 |
| 2,764,443 | 9/1956 | Bennett | 292/240 |
| 2,765,189 | 10/1956 | Forssell | 292/340 |
| 2,861,830 | 11/1958 | Bennett | 292/240 |
| 3,099,473 | 7/1963 | Pastva | 292/240 |
| 3,134,618 | 5/1964 | Heimann | 292/240 |
| 3,160,433 | 12/1964 | Chieger et al. | 292/241 |
| 3,188,128 | 6/1965 | Olander | 292/240 |
| 3,212,805 | 10/1965 | Olander | 292/218 |
| 3,281,177 | 10/1966 | Tenenbaum | 292/241 |
| 3,329,456 | 7/1967 | Olander | 292/218 |
| 3,378,294 | 4/1968 | Olander | 292/218 |
| 3,451,705 | 6/1969 | Turpen | 292/218 |
| 3,464,729 | 9/1969 | Chambers | 292/218 |
| 3,484,127 | 12/1969 | Pastva | 292/218 |
| 3,544,145 | 12/1970 | Cerutti | 292/54 |
| 3,572,794 | 3/1971 | Pastva | 292/218 |
| 3,596,403 | 8/1971 | Carr | 49/256 |
| 3,661,412 | 5/1972 | Morris | 292/213 |
| 3,664,695 | 5/1972 | Sickel | 292/54 |
| 3,695,661 | 10/1972 | Pastva | 292/218 |
| 3,737,183 | 6/1973 | Pastva | 292/7 |
| 3,756,671 | 9/1973 | White | 308/15 |
| 3,784,243 | 1/1974 | Pastva | 292/300 |
| 3,790,355 | 2/1974 | Palisin, Jr. | 29/195 |
| 3,801,146 | 4/1974 | Donath et al. | 292/218 |
| 3,891,112 | 6/1975 | Lycett et al. | 220/1.5 |
| 3,893,734 | 7/1975 | Ulbrich | 384/432 X |
| 3,912,312 | 10/1975 | Cerutti | 292/218 |
| 3,927,816 | 12/1975 | Nakamura | 228/147 |
| 4,014,138 | 3/1977 | White | 49/367 |
| 4,029,349 | 6/1977 | Sweda et al. | 292/241 |
| 4,068,409 | 1/1978 | White | 49/367 |
| 4,087,122 | 5/1978 | Shaw et al. | 292/218 |
| 4,127,291 | 11/1978 | Pelcin | 292/54 |
| 4,146,257 | 3/1979 | Pastva | 292/218 |
| 4,235,463 | 11/1980 | Benevenuta | 292/218 |
| 4,483,557 | 11/1984 | Pastva | 292/218 |
| 4,601,501 | 7/1986 | Pastva | 292/218 |
| 4,690,442 | 9/1987 | Reynard | 292/218 |
| 4,753,466 | 6/1988 | Umebachi et al. | 292/218 |
| 4,768,816 | 9/1988 | Bakula | 292/218 |
| 4,843,857 | 7/1989 | Krieps | 72/58 |
| 4,844,523 | 7/1989 | Pastva | 292/218 |
| 4,844,524 | 7/1989 | Pastva | 292/218 |
| 5,016,393 | 5/1991 | Weinerman | 49/395 |
| 5,046,770 | 9/1991 | Hansen | 292/218 |

RACKING RESISTANT DOOR CONTROL MECHANISM AND METHOD OF FABRICATION

CROSS-REFERENCE TO RELATED PATENT & APPLICATION

Reference is made to a subject-matter related application filed concurrently herewith, Ser. No. 556,008 (Atty's Docket No. 5-120) filed concurrently herewith on Nov. 13, 1995 by Lee S. Weinerman et all entitled CORROSION RESISTANT DOOR CONTROL MECHANISM AND METHOD OF FABRICATION (referred to hereinafter as the "Companion Case"), the disclosure of which is incorporated herein by reference.

Reference also is made to U.S. Pat. No. 4,127,291 issued Nov. 28, 1978 to Albert L. Pelcin entitled DOOR FASTENING APPARATUS (referred to hereinafter as the "Bolt-On Cam Case"), the disclosure of which is incorporated herein by reference.

BACKGROUND OF THE INVENTION

1. Field of the Invention

The present invention relates to the provision and use of a racking resistant door control mechanism for securing pivoted doors of trucks, trailers, large cargo containers and the like, wherein the door control mechanism employs an elongate lock rod that is pivotally mounted on a door by bearing assemblies having steel bearing covers that are positioned and configured to cooperate with three lock-rod-carried components to provide racking resistance, with the lock-rod-carried components including a steel sleeve that surrounds and is welded to the lock rod, and upper and lower cam-type latch members that are configured to engage keeper members carried by upper and lower parts of a door frame for holding the door closed with respect to the frame. More particularly, the present invention relates to a door control mechanism of the type described that is assembled from a simple set of versatile components that preferably include plastic bearing liners of a novel configuration that are housed by differently configured steel bearing covers, with the various metal components of the door control mechanism being corrosion protection coated prior to being welded or otherwise assembled.

2. Prior Art

Load carrying compartments of trucks, trailer bodies and transport cargo containers typically use relative large single or paired sets of pivoted doors to provide access for loading and unloading. Because the door openings are large and often are defined at compartment ends by door frames that are not easily cross-braced and may be subject to distortion known as "racking," each of the pivoted doors typically is secured by a door control mechanism having a lock rod which extends the full height of the door, with the lock rod being rigidly connected at its opposite ends to cam-type latch members configured to engage keeper members carried by top and bottom portions of the door frame, with mounting and operating components of the door control mechanism being carried by the door, and with various ones of these components being configured to cooperate in securing and in resisting racking movements of the closed door and its surrounding door frame.

To resist racking, some prior proposals concentrate principally on improving the configurations of the cam-type latch members and the keeper members they engage to provide highly secure connections therebetween when the latch and keeper members are matingly engaged. While it is known to provide bearings that journal a lock rod, with the bearings having steel covers that engage the cam-type latch members to prevent axial lock rod movement relative to a door on which the bearings mount the lock rod, preventing such axial movement is an important part of providing good racking resistance, and additional measures often are required to address this need.

To provide smooth pivotal operation of bearing mounted lock rods, some use of plastic bearing liners has been attempted. Prior proposals have been subject to criticism due to their complexity, due to their inability to be used with a variety of steel bearing cover configurations, due to their tendency to crack, break or otherwise provide less than a desired degree of service longevity, and/or due to the time and effort that is required to service and replace the plastic bearing liners, as needed. A significant drawback has been a failure of proposed plastic bearing liners to perform smoothly and acceptably in the presence of foreign matter such as dust, sand, dirt and the like.

Because doors of trucks, trailers, cargo containers and the like can be exposed to loadings that are harsh and that may vary as cargo shifts, it is customary to form components such as the lock rods of door control mechanisms from relatively high strength steel. An ever-present concern in door control mechanism design and fabrication is the need for exposed steel surfaces to be adequately protectively coated to resist corrosion, for a normal operating environment may present lengthy exposure to inclement weather, to salt spray and to other conditions that foster corrosion.

One category of corrosion resistant protective coatings that has gained relatively wide acceptance for use in protecting lock rod components of door control mechanisms employs an initial coating of zinc which typically is applied utilizing techniques of hot-dip galvanization, followed by application of a thin layer of chromate conversion coating, followed by application of a clear organic material, typically a clears thermosetting polymer that is cured in place. This general category of corrosion resistant coatings is well known to those who are skilled in the art, and is referred to herein by the term "zinc/chromate/polymer coatings."

Galvanizing techniques that are exemplary of those which are well known to those who are skilled in the art, and that are well suited for use in zinc coating seam-welded steel tubing are described in expired U.S. Pat. No. 3,927,816 issued Dec. 23, 1975, the disclosure of which is incorporated herein by reference. Techniques that are exemplary of those which are well known to those who are skilled in the art, and that are well suited for use in applying chromate conversion coatings and polymer coatings to metal members that have been zinc coated are described in expired U.S. Pat. No. 3,790,355 issued Feb. 5, 1974, the disclosure of which is incorporated herein by reference.

Properly applied zinc/chromate/polymer coatings can provide excellent corrosion resistance at relatively low cost. Good corrosion resistance is best achieved in carefully controlled production environments where each step of the process is appropriately monitored. The application of zinc/chromate/polymer coatings is well suited for use in continuous production processes. For example, zinc/chromate/polymer coatings are applied quite economically and with excellent results to protectively coat very long lengths of newly formed, seam-welded steel tubing that is cut into shorter lengths after being coated; however, present day techniques used in fabricating lock rod assemblies are not suited to work with lengths of tubing that have been protectively coated and that have exposed steel surfaces at opposite ends.

A present day approach used in fabricating protectively coated lock rod assemblies calls for latch members to be welded to opposite ends of elongate lock rods, whereafter these welded assemblies are protectively coated, typically by applying zinc/chromate/polymer coating. However, this present day approach has a number of drawbacks. For example, there is a need to rack each of the long welded assemblies for plating, to reposition the assemblies for the application of a chromate conversion coating, and to again reposition the assemblies for polymer application. Carrying out all three coating steps with intermediate repositioning procedures often results in one or more of the three coatings being applied non-uniformly, sometimes with spots being missed, whereby some protected areas may in fact be less corrosion resistant than others even though the applied coating may present an appearance that is uniform and attractive.

Another drawback of the "weld-first-and-coat-second" approach is that it does not lend itself to the use of the use of a different form of protective coating on the latch members than is used on the lock rods. Different coatings on individual components of a welded lock rod assembly are sometimes desired. For example, cam-type latch members may be suitably protected and given good abrasion resistance simply by utilizing heavy applications of galvanized zinc instead of subjecting these members to the type of zinc/chromate/polymer coating that is applied to elongate lock rod elements.

Another drawback of the "weld-first-and-coat-second" approach is that it lends itself to the production of lock rod assemblies of fixed length that cannot be cut off to accommodate a variety of door heights inasmuch as cam-type latch members already have been welded to opposite ends of each lock rod. Because a lock rod assembly of a fixed length is suited for use only on a door of corresponding height, some manufacturers of vehicles having cargo doors of a variety of heights have been forced to maintain costly and space-consuming inventories of door control mechanisms of lengths that are commensurate with the heights of the doors on which they will be installed.

Because door control mechanisms may need to utilize any of a variety of available latch and keeper configurations in order to provide proper anti-racking, load-retaining capacity at a desired price, a further drawback of the "weld-first-and-coat-second" approach is that all of the resulting lock rod assemblies not only are of limited use due to their fixed length, but also due to the fact that they have, welded in place, a particular type of latch member configuration that must be used with a correspondingly configured type of keeper member configuration. Stated in another way, versatility is held to a minimum by working with rod lock assemblies that are of the "weld-first-and-coat-second" type.

A variety of so-called "touch-up" coatings have been proposed and have been touted as being capable of being applied in a single step, typically as a spray, for purposes such as the "touch-up" of welds that are put in place during component assembly, or the "touch-up" of galvanized surfaces that have been abraded or otherwise exposed during component assembly. For a variety of reasons, however, the use of "touch-up" coatings has drawn objection and has not been widely adopted by the truck and container hardware industry. For one thing, "touch-up" coatings are significantly more expensive to apply, per square inch of coverage, than are more traditional corrosion resistant coatings such as zinc/chromate/polymer. Moreover, unless applied by using carefully controlled procedures, "touch-up" coatings have not been viewed as reliably providing as high a degree of corrosion resistance as tends to be reliably achieved with applications of traditional coatings such as zinc/chromate/polymer.

Some have objected to "touch-up" coatings, pointing to difficulties encountered achieving coating uniformity, and a likelihood that undesirable coating build-up may inhibit proper operation of relatively movable components. Some point to difficulties encountered in matching the appearance of other corrosion resistant coatings used on various components of a door control mechanism, whereby a "touched-up" product may be caused to exhibit a finish that is blotchy or otherwise of non-uniform or unacceptable appearance.

One proposal that has been advanced to permit a protectively coated lock rod assembly (that includes a relatively long lock rod having a latch member welded to the lower end of the rod before the welded assembly was protectively coated) to be cut to length so that an additional latch member can be bolted to the upper end of the lock rod is disclosed by the referenced Bolted Latch Member Case (U.S. Pat. No. 4,127,291). To prepare a protectively coated "lock-rod-with-welded-in-place-lower-latch-member" for use with a door of a particular height, the upper end region of the tube that forms the lock rod is cut to the desired length, and then is drilled to accept a threaded fastener. The upper latch member is installed and clamped in place by tightening a bolt that extends through the upper latch member, through the upper end region of the lock rod, and through a plug that is inserted in the open upper end. While the cut-off and drilled upper end region of the lock rod has unprotected surfaces that remain exposed, these are largely shielded from view by configuring the upper latch member to wrap about outer surface portions of the cut-off upper end region of the lock rod.

The foregoing and other prior proposals have not satisfactorily fulfilled a long-standing need for a new and improved door control mechanism that provides improved racking resistance by addressing in a simply but highly effective way the need to resist axial movements of a lock rod assembly relative to the door on which it is mounted, while also preferably providing an elongate lock rod that that can be cut to length to accommodate a variety of door heights, with smooth pivotal movement of the lock rod relative to the door preferably being assured by the provision and use of well designed plastic bearing liner components that journal the lock rod, with metal components such as the elongate lock rod preferably being protectively coated prior to being cut to length and prior to being welded to latch members at its opposite ends, with versatility preferably being provided by a capability of each lock rod to be used with any of a variety of available racking resistant latch and keeper member configurations, and with the final assembly also preferably being provided with a corrosion resistant finish characterized by high quality and good appearance.

3. The Referenced "Companion Case"

The referenced, concurrently-filed Companion Case addresses the need to provide a door control mechanism that exhibits good corrosion resistance, and that preferably also exhibits a selection of other disclosed features. In preferred practice, the the racking resistant door control mechanism of the present invention incorporates many of the desirable features that are described in greater detail in the Companion Case, several of which are summarized in this section.

In accordance with the invention of the referenced Companion Case, corrosion resistant protective coatings are applied separately to an elongate lock rod element and to such other components as are to be welded to the lock rod element. This is advantageous 1) from the viewpoint of permitting the lock rod element to be protectively coated in a manner different than is used in protectively coating the components that are to be welded to the lock rod element, and 2) from the viewpoint that carefully controlled coating techniques can be employed in different, ideally situated environments to economically achieve optimum results. For example, while it may be desirable to use zinc/chromate/polymer coatings with lock rod elements, a simpler-to-apply protective coating such as heavy zinc applied through the use of galvanizing techniques often is found to work well in rendering cam-type latch members corrosion and abrasion resistant.

An advantage that obtains with the use of the "coat-first-then-cut-and-weld" approach (that is described in greater detail in the Companion Case) is that this approach diminishes the inventory of lock rod assemblies that a manufacturer of vehicles or transport containers must stock in order to accommodate doors of a variety of heights. A stock of lock rod assemblies of "fixed" length no longer needs to be maintained; rather, a simple inventory of lock rods that can be cut-to-length as needed, an an inventory of door control components is all that is required. If an inventory of differently configured latch and keeper configurations is maintained, this will permit precisely the correct latch and keeper configurations can be employed at the top and bottom of each individual door control mechanism.

In accordance with other features of the invention of the Companion Case, welds that are applied to connect components such as latch members and lock-rod-carried sleeves are confined to relatively small areas—areas that preferably are normally out-of-sight. The weld areas are separately protectively coated, typically during final assembly, using a zinc rich, polymer containing touch-up spray that dries to form a film that typically contains about ninety five percent, by weight, of metallic zinc to thereby provide a corrosion resistant coating that is substantially the performance equivalent of hot-dip galvanizing, and that has an appearance that is selected so as to substantially match the appearance of other corrosion resistant coatings applied to the various components of a particular door control mechanism. Spray "touch-up" coatings of the type just described offering a variety of coating-matching appearances are commercially available, for example from ZRC Products Company of Quincy, Mass. 02170, sold under the registered trademark "ZRC" and referred to as "ZRC Cold Galvanizing Compound" or "ZRC Galvilite."

SUMMARY OF THE INVENTION

The present invention addresses the foregoing and other needs, considerations and drawbacks of the prior art by defining an approach that can be utilized to provide a racking resistant door control mechanism formed from a versatile set of components that cooperate effectively to resist axial lock rod movement relative to a door on which the lock rod is mounted, with bearing assemblies playing an important role in providing racking resistance by being held in engagement with lock-rod-carried components that include upper and lower cam-type latch members and a steel sleeve that extends about and is welded to the lock rod at a location spaced a short distance above the location of the lower latch member.

In preferred practice, a racking resistant door control mechanism employs an elongate lock rod that extends the height of a door on which the lock rod is mounted, with the lock rod being journaled for pivotal movement by bearing assemblies having steel covers that are connected by fasteners to the door. The lock rod has upper and lower cam-type latch members welded to its opposite ends for engaging keeper members carried by upper and lower parts of a door frame for holding the door closed. The lock rod also extends through and is welded to a steel sleeve at a location spaced a short distance upwardly from the location of the lower latch member. The steel sleeve and the steel bearing covers are configured and positioned such that the steel bearing covers are held in engagement 1) with the latch members, and 2) with opposite ends of the sleeve, to thereby provide a high degree of resistance to axial movement of the lock rod relative to the door on which it is mounted.

In preferred practice, the steel sleeve has a bottom surface that faces downwardly toward an upwardly facing surface of the bottom latch member, and a bottom bearing cover has a height that is received in a slip fit so as to be closely sandwiched between these downwardly and upwardly facing surfaces—a construction that, in and of itself, serves to prevent axial movement of the lock rod relative to the door to which the bottom bearing cover is bolted.

In preferred practice, the steel sleeve has upwardly and downwardly facing surfaces at its opposite ends, and is sandwiched in a slip fit between the relatively large bottom bearing cover and a relatively smaller strap-like bearing cover that is bolted to the door just atop the sleeve—a construction that also, in and of itself, serves to prevent axial movement of the lock rod relative to the door to which the bottom bearing cover is bolted.

In preferred practice, the two construction arrangements just described, each of which serves independently to block both upward and downward axial movements of the lock rod relative to the door on which it is mounted) are used in combination with still another construction that also serves to prevent axial movement of the lock rod. This third construction utilizes engagement between a bottom surface of the bottom bearing cover and an upwardly facing surface of the bottom latch member (which blocks upward movement of the lock rod relative to the door), and between a top surface of the top bearing cover and a downwardly facing surface of the upper latch member (which blocks downward movement of the lock rod relative to the door). All three of these axial movement blocking constructions used in combination are highly effective in resisting axial lock rod movement—and, preventing this type of movement important in resisting racking.

In preferred practice, lock rod stability is ensured by being journaled at frequent intervals by door-carried bearing assemblies that include a bottom bearing assembly (of which the bottom bearing cover is a component part), a top bearing assembly (of which the top bearing cover is a component part), a third bearing assembly (of which the above-mentioned strap-like bearing cover is a component part), and a fourth bearing assembly (of which a strap-like bearing cover of shape similar to the above-mentioned strap-like bearing cover is a component part), with the fourth bearing assembly being positioned along the length of the lock rod at a central location between the third and top bearing assemblies. In preferred practice, the top and bottom bearing covers are similarly configured, with one being inverted with respect to the other when installed.

In preferred practice, plastic bearing liners are housed by the four bearing covers. Even though the some of the bearing covers may differ from others in configuration, the bearing liners they house preferably are identical. Each plastic bearing liner preferably includes a generally rectangular base component that defines spaced slots into which opposite legs of a U-shaped component extend to maintain alignment of these mated components.

A U-shaped surface of the U-shaped component, and an arcuate-shaped surface defined by the base component cooperate to engage opposite sides of the lock rod to provide good support to the lock rod. Two vertically extending spaces are defined on opposite sides of the lock rod between the components of the liner—spaces wherein there is no liner material extending into engagement with the lock rod. If foreign matter such as dust, sand, dirt or the like has migrated between one of the liner components and the lock rod, these vertical spaces often function to provide downwardly opening discharge passages through which foreign matter may work its way out of the bearing assemblies.

To ensure longevity of service, to provide resistance to cracking and breakage, and to ensure good performance even in the presence of foreign matter, the bearing liner components preferably are fabricated using injection molding techniques and a high performance, abrasion resistant plastic material that also is resistant to cracking and breakage throughout the range of ambient temperatures to which truck and container hardware is likely to be subjected. A variety of suitable plastic materials are commercially available, for example acetal resin sold by E. I. DuPont deNemours & Co., Wilmington, Del. 19898, that is marketed under the registered trademark "DELRIN 500."

The lock rod can be formed from one elongate, full-length element, or from a pair of relatively shorter elongate elements. In preferred practice, if the lock rod is formed from a pair of elements, the steel sleeve is welded to both of the lock rod elements to assist in establishing a strong and rigid connection therebetween.

In preferred practice, the various metal components of the door control mechanism including the steel sleeve and the steel bearing covers are protectively coated before being welded or otherwise assembled. Other features of the invention of the Companion Case also are preferably utilized to advantage. For example, some rigid connections between components of the lock rod assembly preferably are formed by utilizing normally hidden welds of relatively small size that burn through the protective coatings and are, in turn, protectively coated by a zinc rich, polymer containing film applied as a "touch-up" spray that matches the appearances of the corrosion resistant coatings applied to the various metal components.

BRIEF DESCRIPTION OF THE DRAWINGS

These and other features, and a fuller understanding of the invention may be had by referring to the following description and claims, taken in conjunction with the accompanying drawings, wherein:

DESCRIPTION OF THE PREFERRED EMBODIMENT

Figure 1:
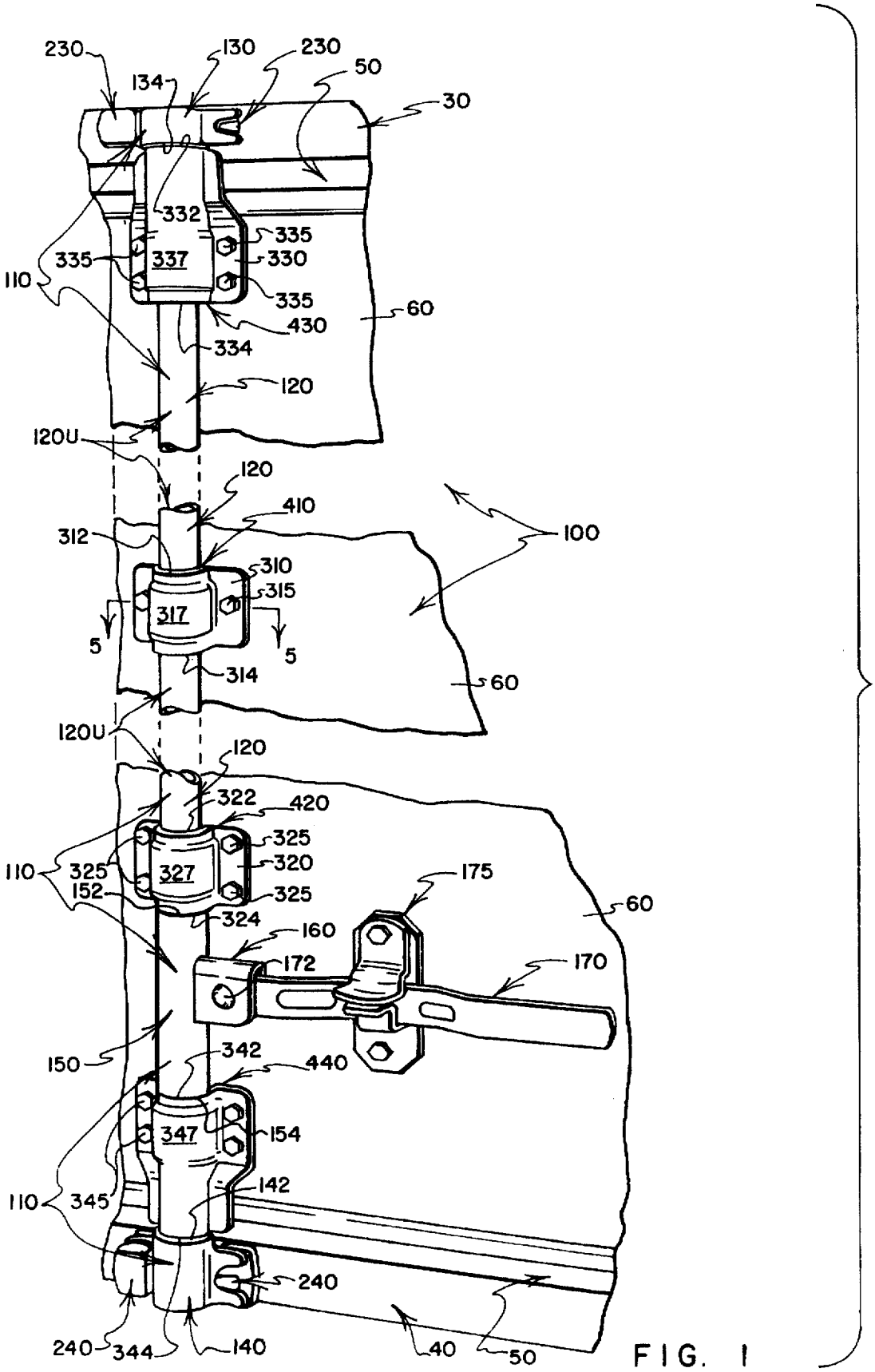
FIG. 1 is a foreshortened perspective view depicting principally front and right side portions of a door control mechanism connected to portions of a vehicle cargo door and an associated frame, with the mechanism including a door mounted, vertically extending lock rod assembly provided at its upper and lower ends with cam-type latch members, with the latch members engaging frame mounted keeper members to hold the door closed with respect to the frame.

Referring to FIG. 1, a door control mechanism that embodies the preferred practice of the present invention is indicated generally by the numeral 100.

Also shown in FIG. 1 are upper and lower frame portions of a load carrying compartment of a truck body, a trailer body or a cargo container, which are designated by the numerals 30, 40, respectively, Defined between the upper and lower door frame portions 30, 40 is a door opening, indicated generally by the numeral 50. A door 60 is shown in closed position—wherein the door 60 closes at least a significant portion of, if not the entirety of, the door opening 50.

In a manner well understood by those who are skilled in the art, the door 60 is hinge-mounted for pivotal movement about a vertically extending axis (not shown) that is located a suitable distance to one side of the depicted door control mechanism 100 (i.e., rightwardly with respect to what is depicted in FIG. 1) so that the door 60 can pivot between an open position (not shown) and the closed position that is depicted in FIG. 1.

Figure 2:
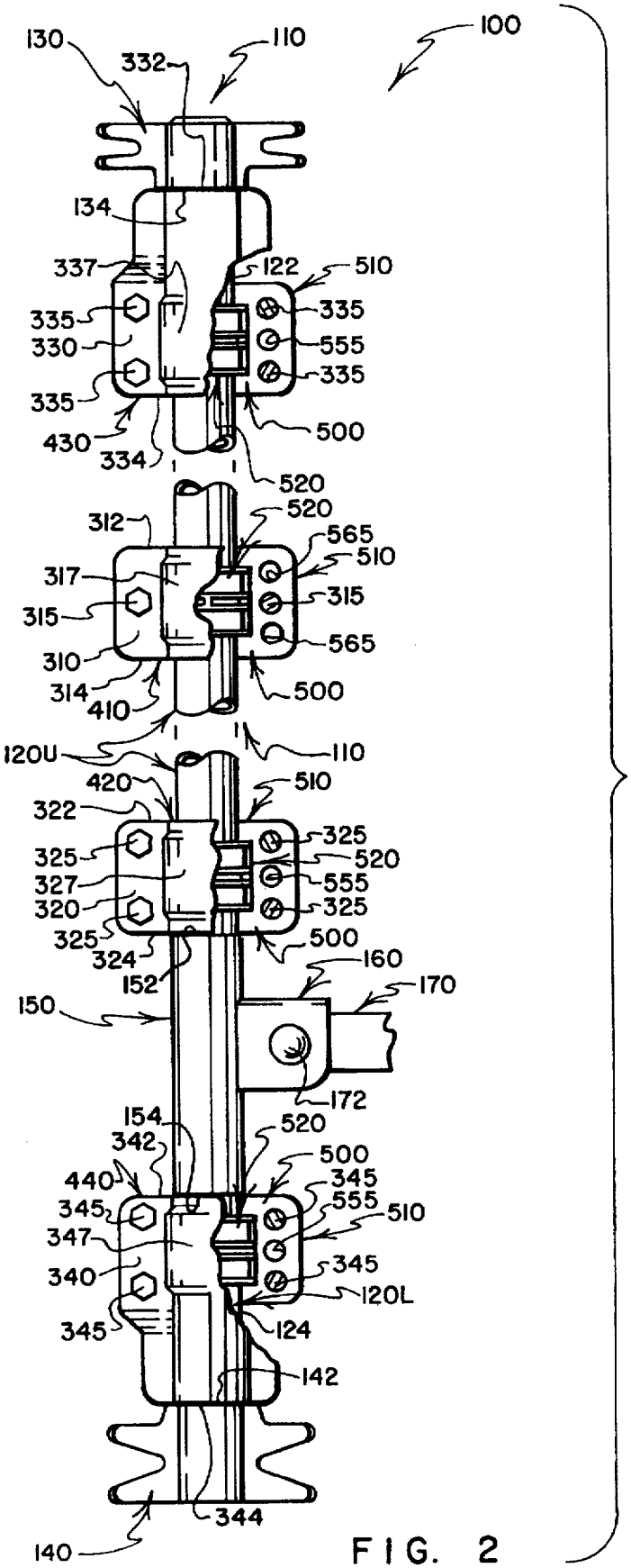
FIG. 2 is a foreshortened front elevational view of the lock rod assembly, with portions broken away to permit underlying features including the locations of four plastic bearing liner assemblies to be viewed.
Figure 3:
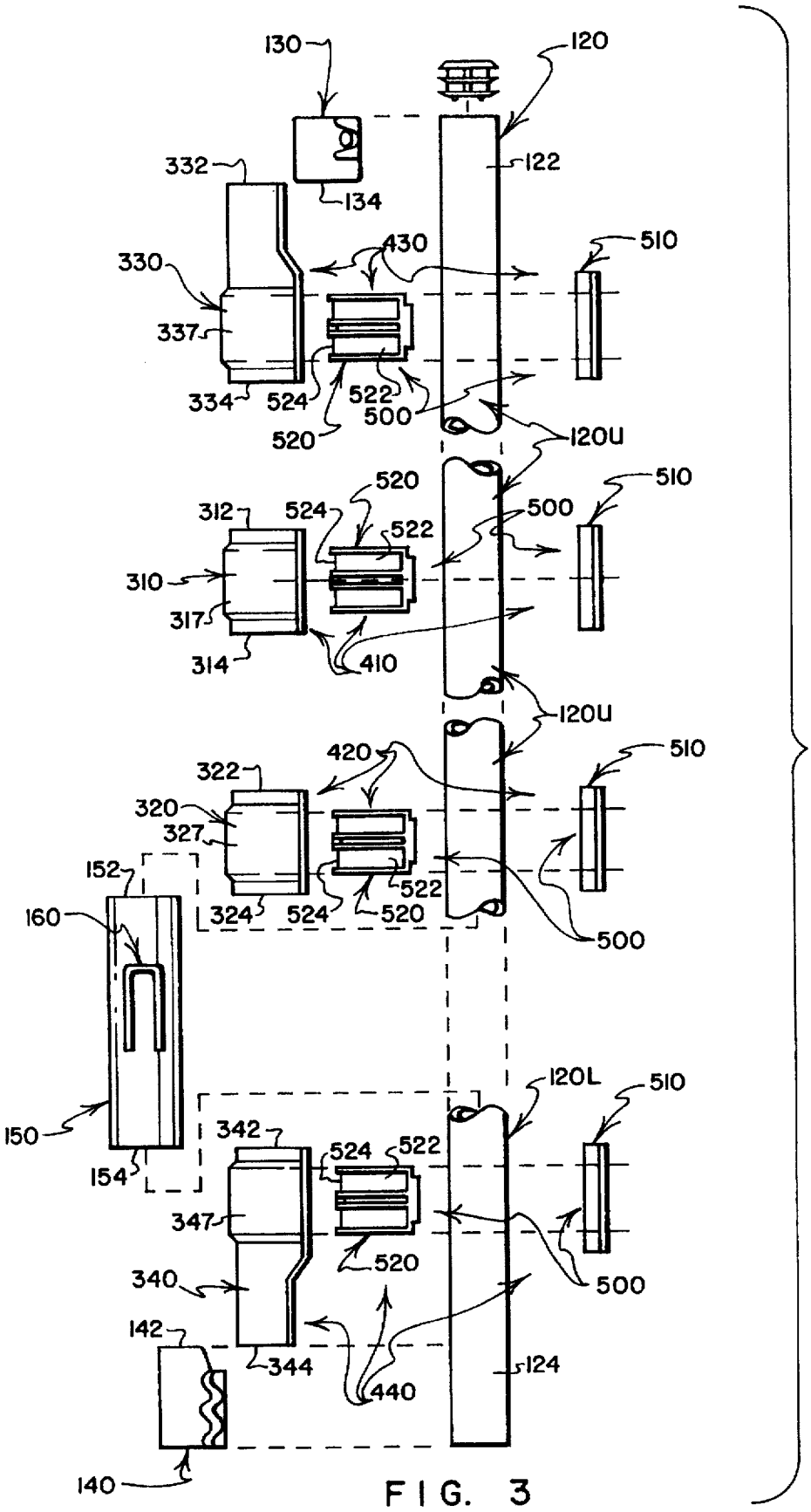
FIG. 3 is a foreshortened, exploded, right side elevational view showing selected components of the rod lock assembly.

Referring to FIGS. 1–3, the door control mechanism 100 includes a welded lock rod assembly that is indicated generally by the numeral 110. The assembly 110 includes an elongate tubular lock rod 120 that has upper and lower end regions 122, 124 (see FIG. 3). An upper cam-type latch member 130 is welded to the upper end region 122. A lower cam-type latch member 140 is welded to the lower end region 124. A steel sleeve 150 (of slightly greater inner diameter than is the outer diameter of the tubular lock rod 120) is slip-fit onto the lock rod 120 and is welded in place.

Referring to FIG. 1, the door control mechanism 100 also includes upper and lower keeper members 230, 240 that are appropriately configured to receive and cooperatively engage the cam-type latch members 130, 140, respectively, to secure the door 60 in the depicted closed position. The upper keeper member 230 is rigidly connected, usually by welding, to the upper door frame portion 30. The lower keeper member 240 is rigidly connected, usually by welding, to the lower door frame portion 40.

The cam-type latch members 130, 140 that are depicted in the drawings are typical of a wide variety of latch member configurations that are commercially available from truck hardware manufacturers such as Eberhard Manufacturing Co., Cleveland, Ohio 44136. In FIG. 1, keeper members 130, 140 that are depicted are typical of a wide variety of keeper member configurations that also are commercially available from truck hardware manufacturers such as Eberhard.

Features of the present invention are in no way restricted to the use of any particular form of latch and/or keeper configuration—except that, in preferred practice, 1) the upper latch member 130 should define a downwardly facing surface 134 that can be engaged by a steel bearing cover (as will be explained later herein), and 2) the lower latch member 140 should define an upwardly facing surface 142

(that can be engaged by another steel bearing cover (as will be explained later herein).

The lock rod 120 preferably is formed from seam-welded steel tubing that preferably has been corrosion protection coated by its manufacturer, for example by applying a zinc/chromate/polymer coating thereto under optimal conditions that permit a high quality corrosion resistant finish to be applied, usually at a time before the newly manufactured tubing has been cut to length. A process by which steel tubing can be galvanized to provide a high quality zinc coating is described in expired U.S. Pat. No. 3,927,816. A process by which a chromate conversion coating followed by an application of clear organic coating such as a thermosetting polymer can be applied to zinc plated tubing is described in expired U.S. Pat. No. 3,790,355. Other commercially practiced protective coating processes that provide zinc/chromate/polymer coatings also can be used.

The lock rod 120 may be defined by a single, full-length tubular member, or may be defined by two shorter tubular members that are arranged end-to-end and rigidly connected to thereby provide a full length lock rod. The reference numeral 120 refers to the entire length of the lock rod—which extends from the upper end region 122 to the lower end region 124. If two lock rod elements are to be used to define a full length lock rod 120, they have lengths that are selected so that their end-to-end juncture is located centrally within the confines of the steel sleeve 150.

Because the door control mechanism will not differ in appearance regardless of whether a single, full length steel tube is used to form the lock rod 120 or whether the lock rod 120 is formed from two shorter tubular elements, there is no need to provide a separate set of drawing views to distinguish the appearances of one-element and two-element lock rods. Therefore, in FIG. 3, the numeral 120U can be thought of as designating either upper portions of a one-element lock rod or an upper of element of a two-element lock rod (which extends upwardly from the sleeve 150 to the upper latch member 130); and, the numeral 120U can be thought of as designating either lower portions of a one-element lock rod or a lower element of a two-element lock rod (which extends downwardly from the sleeve 150 to the lower latch member 140).

Figure 6:
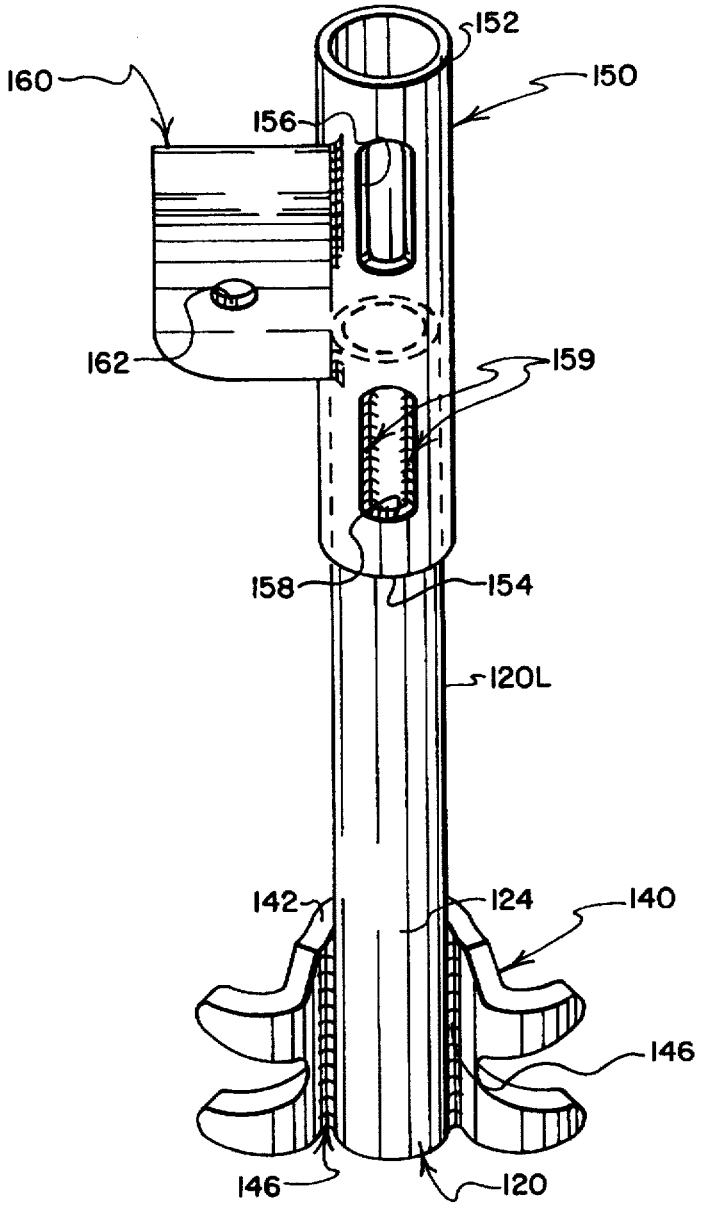

Referring to FIG. 6, the manner in which the lower latch member 140 is welded to the lower end region 124 of the lock rod 120 is shown. Two elongate welds 146 located on opposite sides of the lower end region 124 are utilized to securely connect the lock rod 120 to the lower latch member 140. While no similar depiction is provided of rear portions of the upper latch member 130, it will be readily understood by those who are skilled in the art that substantially identical elongate welds (not shown) preferably are utilized to connect opposite side portions of the upper end region 122 of the lock rod 120 securely to the upper latch member 130.

Referring to FIGS. 1, 2 and 6, the sleeve 150 has an upwardly facing end surface 152 and a downwardly facing end surface 154. A pair of axially spaced, elongate slots 156, 158 are formed through the back side of the sleeve 150. Elongate welds 159 are formed within the confines of the slot 158 to connect the sleeve 150 to the lower lock rod portion 120L; and, identical elongate welds (not shown) are formed within the confines of the slot 156 to connect the sleeve 150 to the upper lock rod portion 120U (once a lower end of the upper lock rod portion 120U has been inserted half-way down into the sleeve 150 to abuttingly engage in end-to-end relationship the upper end of the lower lock rod portion 120L which is depicted in phantom in FIG. 6).

If the lock rod 120 is formed from a single, full-length reach of steel tubing, the welds 159 formed in the slot 158, and the identical welds (not shown) formed in the slot 156 will securely connect the sleeve 150 to the one-piece lock rod 120. If the lock rod 120 is formed from separate lower and upper lengths of tubing 120L, 120U, respectively, the described welds will enable the welded-in-place sleeve 150 to provide a secure connection between the lower and upper lock rod elements 120L, 120U.

Referring to FIGS. 1, 3 and 6, a U-shaped handle mounting bracket 160 is welded to the outside surface of the sleeve 150. The bracket 160 provides a mount that supports an elongate operating handle 170 that is used to apply force to the lock rod 120 to pivot the lock rod 120, whereby the lock rod 120, in turn, correspondingly pivots the upper and lower latch members 130, 140. A fastener 172 extends through a hole 162 (see FIG. 6) formed in the bracket 160 and through an aligned hole (not shown) formed in one end region of the handle 170 to connect the handle 170 to the bracket 160. A handle retainer assembly 175 (see FIG. 1) of conventional form is mounted on the door 60 for receiving and releasably retaining the handle 170 to secure the door closure mechanism 100 in the locked position depicted in FIG. 1—wherein the door control mechanism 100, in turn, secures the door 60 closed.

Referring to FIGS. 1 and 2, four bearing assemblies 410, 420, 430, 440 are mounted on the door 60 and serve to journal the lock rod 120 for pivotal movement about a pivot axis (not shown) that extends centrally along the length of the lock rod 120. The bearing assemblies have stamped steel covers 310, 320, 330, 340, respectively. The bearing assemblies 410, 420 are located between the upper bearing assembly 430 and the lower bearing assembly 440.

The bearing assembly 410 has a stamped, strap-like steel cover 310 that defines upper and lower surfaces 312, 314, respectively, and that is connected to the door 60 by two bolts 315. The bearing assembly 420 has a stamped, strap-like steel cover 320 that defines upper and lower surfaces 322, 324, respectively, and is connected to the door 60 by four of bolts 325. The upper bearing assembly 430 has a complexly configured, stamped steel cover 330 that defines upper and lower surfaces 332, 334, respectively, and that is connected to the door 60 by four bolts 335. The lower bearing assembly 440 has a stamped steel cover 340 that is identical to the upper cover 330 but is inverted, that defines upper and lower surfaces 342, 344, respectively, and that is connected to the door 80 by four bolts 345.

The positioning of the bearing assembly 410 is not especially critical inasmuch as the purpose principally served by the bearing assembly 410 is that of stabilizing the lock rod 120 at a location generally mid-way between the bearing assemblies 420, 430 to ensure that the lock rod 120 does not deflect from its center axis, and to ensure that portions of the door 60 that are connected to the lock rod 120 by the bearing assembly 410 do not move relative to each other. The positioning of the bearing assemblies 420, 430, 440, on the other hand, is important inasmuch as racking resistant features of the door control mechanism 100 rely on proper positioning of the bearing covers 320, 330, 340.

By way of a first example, the sleeve 150 is sandwiched between the bearing covers 320, 340, with the top surface 152 of the sleeve 150 engaging the bottom surface 324 of the cover 320, and with the bottom surface 154 of the sleeve 150 engaging the top surface 342 of the cover 340—which arrangement constitutes a first paired set of surface engagements (i.e., a first bearing-cover-related arrangement of paired surface engagements) that is utilized by the door control mechanism 100 to prevent both relative upward and relative downward axial movements of the lock rod 120 with respect to the door 60. Stated in another way, the sandwiching of the sleeve 150 by the bearing covers 320, 340 is the first of three racking resistant features relied upon, in combination, by the door control mechanism 100.

By way of a second example, the lower bearing cover 340 is sandwiched between the sleeve 150 and the lower latch member 140, with the top surface 342 of the lower bearing cover 340 engaging the bottom surface 154 of the sleeve, and with the bottom surface 344 of the lower bearing cover 140 engaging the top surface 142 of the lower latch member 140—which arrangement constitutes a second paired set of surface engagements (i.e., a second bearing-cover-related arrangement of paired surface engagements) that is utilized by the door control mechanism 100 to prevent both relative upward and relative downward axial movements of the lock rod 120 with respect to the door 60. Stated in another way, the sandwiching of the lower bearing cover 340 by the members 140, 150 is the second of three racking resistant features relied upon, in combination, by the door control mechanism 100.

By way of a third example, the upper bearing cover 330 has an upper surface 332 which is held in engagement with the lower surface 134 of the upper latch member 130, and the lower bearing cover 340 has a lower surface 344 that is held in engagement with the upper surface 142 of the lower latch member 140—which arrangement constitutes a third paired set of surface engagements (i.e., a third bearing-cover-related arrangement of paired surface engagements) that is utilized by the door control mechanism 100 to prevent both relative upward and relative downward axial movements of the lock rod 120 with respect to the door 60. Stated in another way, the sandwiching of the door-interconnected upper and lower bearing covers 330, 340 by the upper and lower latch members 130, 140 is the third of three racking resistant features relied upon, in combination, by the door control mechanism 100.

Looking more closely at the limited number of components that are employed in defining all three of the above described paired sets of racking resistant features, it will be seen that, only three lock-rod-carried elements (namely the latch members 130, 140 and the sleeve 150) and only three door-carried elements (namely the bearing covers 320, 330, 340) are utilized in forming all three of the described "sandwichings" of components! The use of so few components to achieve rather a lot of anti-racking capability is possible due to the in-series, in-line positioning of four of the essential elements (namely the lower latch member 140, the lower bearing cover 340, the sleeve 150 and the bearing cover 320—which are arranged in series in engagement one-with-the-next, with no intermediate spaces interposed between any two adjacent pairs of these four elements.

This is an unusually economical approach that maximizes the use that can be made of a limited set of simple components to achieve a powerful degree of "anti-racking" capability, and largely boils down to a matter of providing the lock rod with a double-ended sleeve 150, and then utilizing the sleeve 150 and the latch members 130, 140 to provide racking resistance by strategically positioning the three bearing covers 320, 330, 340 to engage the lock-rod-carried members 130, 140, 150.

Additional features of the door control system 100 reside in the use that is made by each of the bearing assemblies 410, 420, 430, 440 of plastic bearing liners (indicated generally by the numeral 500 in FIG. 4) that feature some novel points of design. To begin with, while the bearing covers 310, 320, 330, 340 may differ one from another in configuration, identically configured enlarged regions 317, 327, 337, 347 are defined by the bearing covers 310, 320, 330, 340 so that identically configured plastic bearing liners 500 can be housed by the enlarged regions 317, 327, 337, 347.

Figure 4:
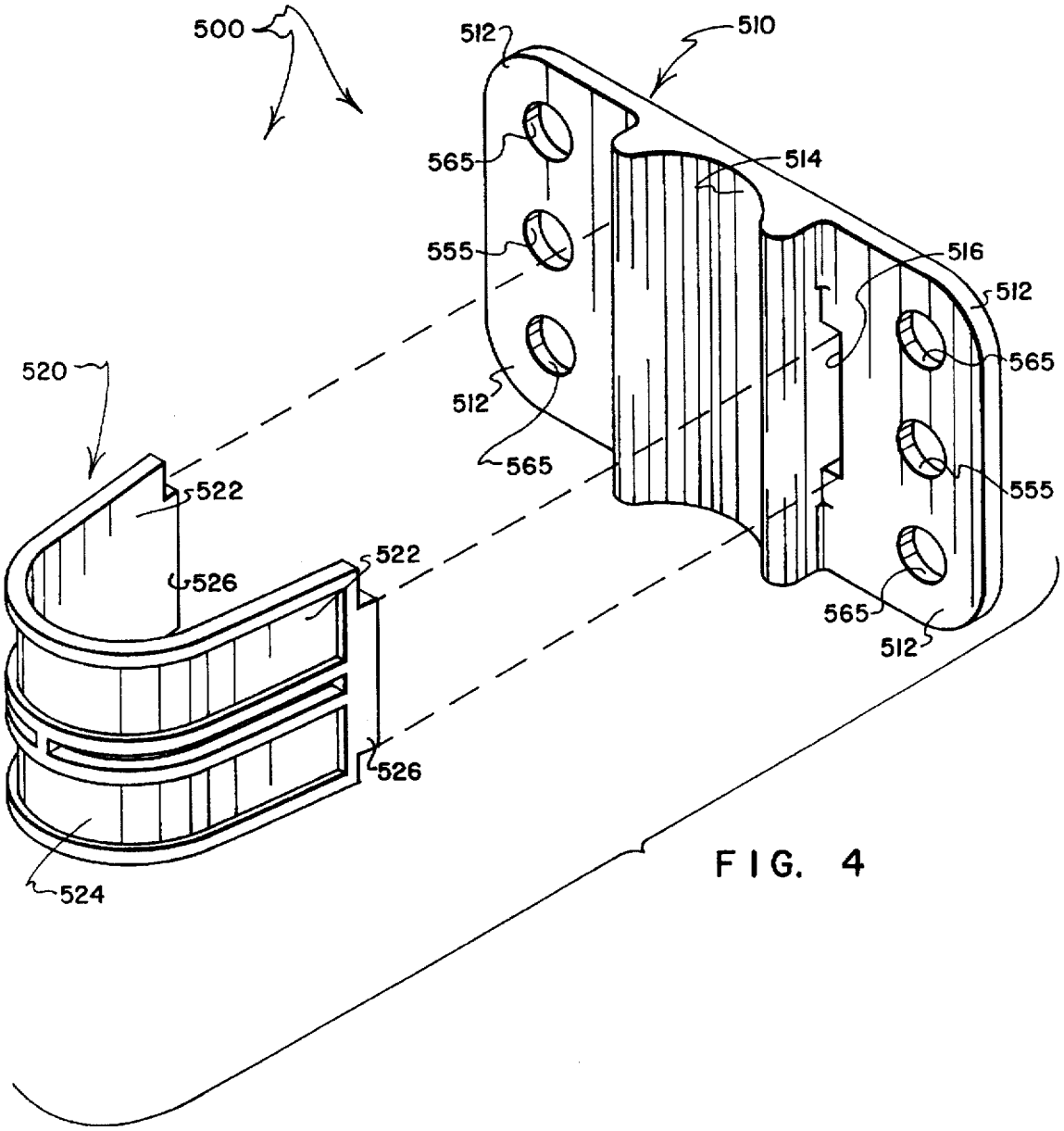
FIG. 4 is an exploded view, on an enlarged scale, showing components of one of the plastic bearing liner assemblies.

Referring to FIG. 4, each of the bearing liners 500 includes a pair of components that mate when assembled to provide lock rod bearings of good integrity. A plate-like component 510 that is of generally rectangular shape except that its corners 512 are generously rounded. A U-shaped component 520 has opposed leg portions 522 that are interconnected by a C-shaped portion 524. Projections 526 of generally rectangular cross-section are carried at the distal ends of the leg portions 522, and are configured to be snugly received with generally rectangular openings 516 (see FIG. 5) formed in the plate-like component 510. A sizable arcuate surface 514 is defined by the plate-like component 510 and is located between the openings 516.

Figure 5:
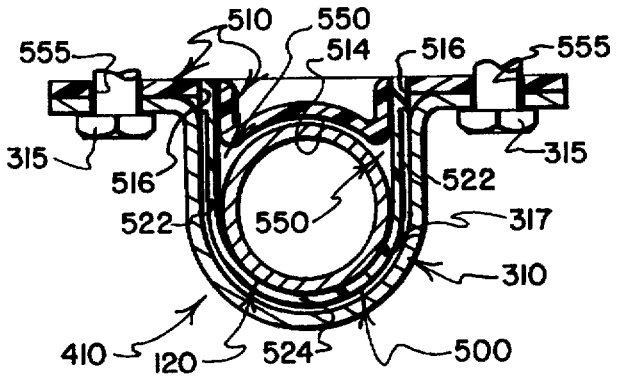
FIG. 5 is a sectional view, on an enlarged scale, as seen from a plane indicated by a line 5—5 in FIG. 1; and, FIG. 6 is a perspective view, on an enlarged scale, showing rear features of some assembled components of the rod lock assembly.

Referring to FIG. 5 wherein one of the liners 500 is shown in cross-section housed within the enlarged region 317 of the bearing cover 310, arcuate surface 514 and the C-shaped portion 524 have radii of curvature that match the outer diameter of the lock rod 120—thereby enabling the surface 514 and the C-shaped portion 524 to engage opposite sides of the lock rod 120 so as to confine the rotation of the lock rod to an axis (not shown) that is centered between the arcuate surface 514 and the inner face of the C-shaped portion 524.

A feature of the bearing liner assembly 500 that is best seen in FIG. 5 is that vertical passages, indicated generally by the numerals 550, are provided near junctures of the arcuate surface 514 with the leg portions 522. The vertical passages 550 aid in ducting foreign matter downwardly for discharge from the bearing assemblies 410, 420, 430, 440, and thereby help to ensure that the bearing assemblies 410, 420, 430, 440 smoothly journal the lock rod 120 for a service life of good longevity.

Four "corner" mounting holes 565, and two "center" mounting holes 555 are formed through the plate-like component 510. The four corner holes 565 receive the four bolts 325 that are used to bolt the bearing cover 320 to the door 60. The two center holes 555 receive the two bolts 315 that are used to bolt the bearing cover 310 to the door 60. The cover 320 employs a total of four bolts because it is an "anti-racking" component (as is described above) that may be axially loaded in the presence of forces that tend to cause racking. The cover 310 employs a total of two bolts because it is not subjected to axial loadings and does not perform an "anti-racking" function.

In preferred practice, the rear and front components 310, 320 are formed from a substantially rigid, strong, crack resistant plastics material using extrusion molding techniques. Because door control assemblies need to operate smoothly in ambient temperatures typically extending from below zero degrees Fahrenheit (and sometimes in the presence of severe ice buildup) to above one hundred degrees Fahrenheit, selection of a plastics material that is serviceable in a wide range of temperatures and that resists "freeze up" during cold winter days is desirable. As those who are skilled in the art will readily understand, a variety of plastics materials suitable for this purpose are commercially available. An acetal resin sold by E. I. DuPont deNemours & Co., Wilmington, Del. 19898 under the registered trademark "DELRIN 500" is, for example, a good commercially available choice.

Referring to FIG. 3, the open upper end of the lock rod 120 preferably is closed by inserting therein a suitably configured, molded plastic plug 600. The plug 600 is received within the upper end region 122 in a press-fit, and is deliberately sized to be difficult to remove after it has been pressed into position.

In accordance with the preferred practice of the present invention, the welded lock rod assembly preferably is provided with a desired degree of corrosion resistance by 1) protectively coating the lock rod 120 (or the upper and lower components 120U, 120L that are to be assembled to form the lock rod 120) prior to cutting the lock rod to length, and prior to welding and to the carrying out of other significant assembly effort, with the application of protective coating being carried out under optimal conditions, preferably in the facility of the manufacturer of the rod, and preferably utilizing what has been described herein as a zinc/chromate/polymer coating; 2) protectively coating the latch members 130, 140 and the steel sleeve 150 separately, preferably also under optimal conditions, also at a time prior to assembly; 3) welding the latch members 130, 140 to the lock rod 120 utilizing small elongate welds located so that they normally are hidden; and, 4) applying touch-up spray of the type described previously to form a zinc-rich polymer containing film in limited areas where metal surface was exposed when the lock rod was cut to length, and in limited areas where the elongate welds were formed, with the touch-up coating being of a type that matches as closely as possible the finished appearance of other corrosion resistant coating applied to adjacent surface areas.

The sub-assembly that is depicted in FIG. 6 is suggestive of a wide range of inventory stocking options that are offered by the versatile components of the door control mechanism 100. The various described components can be stocked individually or in various forms of sub-assembly that will accommodate needed versatility. For example, if a variety of latch member configurations are going to be needed, the latch members 130, 140 probably should not be sub-assembled with the lock rod elements 120U, 120L; however, if only one latch member configuration is to be employed on a plurality of door control mechanisms 100, it may be desirable to weld the upper latch member 130 to the upper lock rod element 120U, and to incorporate the lower latch member 140 into a sub-assembly of the type shown in FIG. 6 so that the only last minute modification that will need to be made during final assembly is to cut the upper lock rod element 120U to length to accommodate the height of the particular door on which it is to be installed.

Although the invention has been described in its preferred form with a certain degree of particularity, it is understood that the present disclosure of the preferred form has been made only by way of example, and that numerous changes in the details of construction and the combination and arrangement of parts may be resorted to without departing from the spirit and scope of the invention as hereinafter claimed. It is intended that the patent shall cover, by suitable expression in the appended claims, whatever features of patentable novelty exist in the invention disclosed.

What is claimed is:

1. A door control mechanism for securing a door, swingable about a generally vertical axis, in closed position closing a door opening bordered at its top and bottom by top and bottom portions of a frame, the door control mechanism comprising:

a) an elongate tubular lock rod formed from steel tubing and defining upper and lower end regions near opposite ends thereof;

b) an elongate tubular steel sleeve of given length encircling the tubular lock rod and defining at opposite ends of the given length thereof an upwardly facing sleeve engagement surface and a downwardly facing sleeve engagement surface;

c) an upper cam-type latch member secured to the upper end region of the lock rod and defining a downwardly facing latch member engagement surface;

d) a lower cam-type latch member secured to the lower end region of the lock rod and defining an upwardly facing latch member engagement surface;

e) keeper means adapted to be affixed to the top and bottom portions of the frame at locations that are adjacent the upper and lower latch members when the door is closed for receiving the upper and lower latch members to secure the door closed;

f) bearing means including a plurality of spaced bearing members that receive portions of the lock rod for mounting the lock rod on the door to extend the height of the door, and for journaling the lock rod for pivotal movement about an imaginary central axis that extends longitudinally with respect to the lock rod and that is oriented to extend generally vertically when the bearing means mount the lock rod to extend the height of the door;

g) with the plurality of spaced bearing members including:

1) an upper bearing member having an upper steel bearing cover that defines an upwardly facing contact surface of the upper steel bearing cover;

2) a lower bearing member having a lower steel bearing cover that defines on opposed upper and lower sides thereof an upwardly facing contact surface of the lower bearing cover and a downwardly facing contact surface of the lower steel bearing cover; and, 3) a central bearing member having a central steel bearing cover that defines a downwardly facing contact surface of the central steel bearing cover;

h) means for pivoting the lock rod about the imaginary central axis;

i) with the lock rod being prevented from moving axially along the imaginary central axis relative to the door by:

1) connecting the upper bearing member to the door so as to position the upper steel bearing cover such that the downwardly facing engagement surface of the upper latch member is engaged by the upwardly facing contact surface of the upper steel bearing cover;

2) connecting the lower bearing member to the door so as to position the lower steel bearing cover such that the upwardly facing engagement surface of the lower latch member is engaged by the downwardly facing contact surface of the lower steel bearing cover;

3) connecting the central bearing member to the door so as to position the downwardly facing contact surface of the central steel bearing cover facing toward the upwardly facing contact surface of the lower steel bearing cover but spaced therefrom along the imaginary central axis by a given distance that substantially equals said given length of the elongate steel sleeve; and, 4) connecting the elongate steel sleeve to the tubular lock rod at a location between the lower bearing member and the central bearing member so that the upwardly facing sleeve engagement surface is engaged by the downwardly facing contact surface of the central steel bearing cover, and so that the downwardly facing sleeve engagement surface is engaged by the upwardly facing contact surface of the lower steel bearing cover.

2. The door control mechanism of claim 1 wherein the tubular lock rod is formed from a single continuous length of steel tubing.

3. The door control mechanism of claim 1 wherein the tubular lock rod is formed by two lengths of steel tubing arranged end-to-end to form a juncture therebetween, and the tubular sleeve bridges the juncture and is connected by a welding process to each of the two lengths of tubing.

4. The door control mechanism of claim 1 wherein the upper and lower latch members and the tubular sleeve all are connected to the lock rod by a welding process; the welding process is carried out at a time after the lock rod has been protectively coated to provide corrosion resistance; the welding process results in welds being formed that burn through the protective coatings; and the welds are protectively coated to provide corrosion resistance by a dried film of zinc and clear organic coating.

5. The door control mechanism of claim 1 wherein the steel sleeve has a generally cylindrical side wall through which an opening is formed, and at least one weld is provided within the confines of said opening to connect the sleeve to the lock rod.

6. The door control mechanism of claim 1 wherein the tubular lock rod is formed from first and second lengths of steel tubing that each are arranged adjacent each other to form an end-to-end juncture and to extend from the juncture substantially coaxially along the imaginary central axis, with said upper end region of the lock rod being defined by the first tubing length, with said lower end region being defined by the second tubing length, and with the steel sleeve bridging said juncture and being secured to each of the first and second lengths in the vicinity of said juncture.

7. The door control mechanism of claim 1 wherein a selected one of the bearing members includes a plastic bearing liner that is at least partially enclosed by the steel bearing cover of the selected bearing member, with aligned holes being formed through the the bearing cover and the plastic bearing liner to receive threaded fasteners that mount the selected bearing member on the door but can be removed to permit the plastic bearing liner to be serviced or replaced, as needed.

8. The door control mechanism of claim 1 wherein a selected one of the bearing members includes a plastic bearing liner carried, at least in part, in an enlarged centrally located formation of the steel bearing cover of the selected bearing member.

9. The door control mechanism of claim 8 wherein the plastic bearing liner includes a backing member that extends between a back surface of the lock rod and the door, and a U-shaped member that has opposed legs that extend along opposite sides of the lock rod and are connected by a C-shaped formation that wraps about a front surface of the lock rod, with the C-shaped formation and the backing member cooperating to define arcuate, lock-rod-engaging surfaces that extend into engagement with the front and back surfaces of the lock rod to assist in journaling the lock rod for pivotal movement about said central axis.

10. The door control mechanism of claim 9 wherein the opposed legs carry projecting tab formations that are configured to be received within a pair of spaced slots formed in the backing member.

11. The door control mechanism of claim 1 wherein the means for pivoting the lock rod about the imaginary center axis includes an elongate handle connected near one end thereof to the elongate steel sleeve.

12. A door control mechanism for securing a door, swingable about a generally vertical axis, in closed position closing a door opening bordered at its top and bottom by top and bottom portions of a frame, the door control mechanism comprising:

a) an elongate tubular lock rod formed from steel tubing and defining upper and lower end regions near opposite ends thereof;

b) a tubular steel sleeve encircling and being secured to the tubular lock rod at a location between the upper end region and the lower end region, and defining an upwardly facing sleeve engagement surface and a downwardly facing sleeve engagement surface located near opposite ends of the sleeve;

c) an upper cam-type latch member secured to the upper end region of the lock rod and defining a downwardly facing latch member engagement surface;

d) a lower cam-type latch member secured to the lower end region of the lock rod and defining an upwardly facing latch member engagement surface;

e) keeper means adapted to be affixed to the top and bottom portions of the frame at locations that are adjacent the upper and lower latch members when the door is closed for receiving the upper and lower latch members to secure the door closed;

f) bearing means including a plurality of spaced bearing members that receive portions of the lock rod for mounting the lock rod on the door to extend the height of the door, and for journaling the lock rod for pivotal movement about an imaginary central axis that extends longitudinally with respect to the lock rod and that is oriented to extend generally vertically when the bearing means mount the lock rod to extend the height of the door, with each of the spaced bearing members having a separate steel bearing cover that defines an associated upwardly facing contact surface and an associated downwardly facing contact surface;

g) means for pivoting the lock rod about the imaginary central axis;

h) with the lock rod being prevented from moving axially along the imaginary central axis relative to the door by locating the steel bearing covers such that each of the two downwardly facing engagement surfaces is engaged by a different one of the upwardly facing contact surfaces, and such that each of the two upwardly facing engagement surfaces is engaged by a different one of the downwardly facing contact surfaces; and, i) wherein a selected one of the spaced bearing members includes a plastic bearing liner having a pair of components that cooperate to journal the lock rod, and that cooperate to define a pair of spaced, generally vertically extending passages located adjacent the lock rod, through which particles of foreign matter may migrate so as to discharge from the vicinity of the bearing liner.

13. The door control mechanism of claim 12 wherein the tubular lock rod is formed from a single continuous length of steel tubing.

14. The door control mechanism of claim 12 wherein the tubular lock rod is formed by two lengths of steel tubing arranged end-to-end to form a juncture therebetween, and the tubular sleeve bridges the juncture and is connected by a welding process to each of the two lengths of tubing.

15. The door control mechanism of claim 12 wherein the upper and lower latch members and the tubular sleeve all are connected to the lock rod by a welding process; the welding process is carried out at a time after the lock rod has been protectively coated to provide corrosion resistance; the welding process results in welds being formed that burn through the protective coatings; and the welds are protectively coated to provide corrosion resistance by a dried film of zinc and clear organic coating.

16. The door control mechanism of claim 12 wherein the steel sleeve has a generally cylindrical side wall through which an opening is formed, and at least one weld is provided within the confines of said opening to connect the sleeve to the lock rod.

17. The door control mechanism of claim 12 wherein the tubular lock rod is formed from first and second lengths of steel tubing that each are arranged adjacent each other to form an end-to-end juncture and to extend from the juncture substantially coaxially along the imaginary central axis, with said upper end region of the lock rod being defined by the first tubing length, with said lower end region being defined by the second tubing length, and with the steel sleeve bridging said juncture and being secured to each of the first and second lengths in the vicinity of said juncture.

18. The door control mechanism of claim 12 wherein a selected one of the bearing members includes a plastic bearing liner that is at least partially enclosed by the steel bearing cover of the selected bearing member, with aligned holes being formed through the the bearing cover and the plastic bearing liner to receive threaded fasteners that mount the selected bearing member on the door but can be removed to permit the plastic bearing liner to be serviced or replaced, as needed.

19. The door control mechanism of claim 12 wherein a selected one of the bearing members includes a plastic bearing liner carried, at least in part, in an enlarged centrally located formation of the steel bearing cover of the selected bearing member.

20. The door control mechanism of claim 19 wherein the plastic bearing liner includes a backing member that extends between a back surface of the lock rod and the door, and a U-shaped member that has opposed legs that extend along opposite sides of the lock rod and are connected by a C-shaped formation that wraps about a front surface of the lock rod, with the C-shaped formation and the backing member cooperating to define arcuate, lock-rod-engaging surfaces that extend into engagement with the front and back surfaces of the lock rod to assist in journaling the lock rod for pivotal movement about said central axis.

21. The door control mechanism of claim 20 wherein the opposed legs carry projecting tab formations that are configured to be received within a pair of spaced slots formed in the backing member.

22. The door control mechanism of claim 12 wherein the means for pivoting the lock rod about the imaginary center axis includes an elongate handle connected near one end thereof to the tubular steel sleeve.

23. A door control mechanism for securing a door, swingable about a generally vertical axis, in closed position closing a door opening bordered at its top and bottom by top and bottom portions of a frame, the door control mechanism comprising:

a) an elongate lock rod formed from steel tubing having inner and outer surfaces that have been protectively coated to resist corrosion, cut to length to extend the height of a swingable door on which the lock rod is to be installed and to define upper and lower end regions near opposite ends thereof, with the corrosion resistant protective coating having been applied before the lock rod has been cut to length;

b) an elongate tubular steel sleeve of given length encircling the tubular lock rod and defining at opposite ends of the given length thereof an upwardly facing sleeve engagement surface and a downwardly facing sleeve engagement surface;

c) bearing means including a plurality of spaced bearing members that receive portions of the lock rod for mounting the lock rod on the door to extend the height of the door, and for journaling the lock rod for pivotal movement about an imaginary central axis that extends longitudinally with respect to the lock rod and that is oriented to extend generally vertically when the bearing means mount the lock rod to extend the height of the door;

d) with the plurality of spaced bearing members including:

1) an upper bearing member having an upper steel bearing cover that defines an upwardly facing contact surface of the upper steel bearing cover;

2) a lower bearing member having a lower steel bearing cover that defines on opposed upper and lower sides thereof an upwardly facing contact surface of the lower bearing cover and a downwardly facing contact surface of the lower steel bearing cover; and, 3) a central bearing member having a central steel bearing cover that defines a downwardly facing contact surface of the central steel bearing cover;

e) means for pivoting the lock rod about the imaginary central axis;

f) an upper cam-type latch member protectively coated to resist corrosion and secured to the upper end region of the lock rod by a first welding operation conducted at a time after both the lock rod and the upper latch member have been protectively coated, with the first welding operation forming a first weld that burns through the protective coating of the lock rod and the upper latch member in a relatively small first weld area that is largely hidden from view by the upper latch member when the door control mechanism holds the door in closed position, and with a first application of a zinc and clear organic film being applied to a first limited area encompassing the first weld area to protectively coat the first weld area to resist corrosion;

g) a lower cam-type latch member protectively coated to resist corrosion and secured to the lower end region of the lock rod by a second welding operation conducted at a time after both the lock rod and the lower latch member have been protectively coated, with the second welding operation forming a second weld that burns through the protective coating of the lock rod and the lower latch member in a relatively small second weld area that is largely hidden from view by the lower latch member when the door control mechanism holds the door in closed position, and with a second application of a zinc and clear organic film being applied to a second limited area encompassing the second weld area to protectively coat the second weld area to resist corrosion;

h) keeper means adapted to be affixed to the top and bottom portions of the frame at locations that are adjacent the upper and lower latch members when the door is closed for receiving the upper and lower latch members to secure the door closed; and, i) with the lock rod being prevented from moving axially along the imaginary central axis relative to the door by:

1) connecting the upper bearing member to the door so as to position the upper steel bearing cover such that a downwardly facing engagement surface of the upper latch member is engaged by the upwardly facing contact surface of the upper steel bearing cover;

2) connecting the lower bearing member to the door so as to position the lower steel bearing cover such that an upwardly facing engagement surface of the lower latch member is engaged by the downwardly facing contact surface of the lower steel bearing cover;

3) connecting the central bearing member to the door so as to position the downwardly facing contact surface of the central steel bearing cover facing toward the upwardly facing contact surface of the lower steel bearing cover but spaced therefrom along the imaginary central axis by a given distance that substantially equals said given length of the elongate steel sleeve; and, 4) connecting the elongate steel sleeve to the tubular lock rod at a location between the lower bearing member and the central bearing member so that the upwardly facing sleeve engagement surface is engaged by the downwardly facing contact surface of the central steel bearing cover, and so that the downwardly facing sleeve engagement surface is engaged by the upwardly facing contact surface of the lower steel bearing cover.

24. The door control mechanism of claim 23 wherein the elongate lock rod has at least one end where an area of steel from which the lock rod is formed was left exposed when the lock rod was cut to length, and a third application of a zinc and clear organic film is applied to a limited end area encompassing this exposed area to protectively coat the exposed area to resist corrosion.

25. The door control mechanism of claim 23 wherein the elongate lock rod is formed from a single continuous length of steel tubing.

26. The door control mechanism of claim 23 wherein the upper latch member is welded to said upper end region and the first application of film is applied to the first limited area to form a sub-assembly of the upper latch member and the lock rod at a time before the lock rod is cut to length.

27. The door control mechanism of claim 23 wherein the elongate lock rod is formed from first and second lengths of steel tubing that have been protectively coated to resist corrosion arranged adjacent each other to form an end-to-end juncture and to extend from the juncture substantially coaxially along the imaginary central axis, with said upper end region of the lock rod being defined by the first tubing length, with said lower end region being defined by the second tubing length, with said sleeve extending about and bridging said juncture.

28. The door control mechanism of claim 23 wherein the corrosion resistant protective coating that is applied to the lock rod before the lock rod is cut to length is a zinc/chromate/polymer coating.

29. The door control mechanism of claim 23 wherein the zinc and clear organic film is deposited by spray, with the dried film containing about ninety five percent, by weight, zinc.

30. The door control mechanism of claim 23 wherein the means for pivoting the lock rod about the imaginary center axis includes an elongate handle connected near one end thereof to the elongate steel sleeve.

31. A door control mechanism for securing a door, swingable about a generally vertical axis, in closed position closing a door opening bordered at its top and bottom by top and bottom portions of a frame, the door control mechanism comprising:

a) an elongate lock rod for extending the height of a swingable door on which the lock rod is to be installed, with the lock rod having upper and lower end regions;

b) bearing means including a plurality of bearing support members for supporting and journaling the lock rod at spaced locations along the length of the lock rod, including upper and lower bearing assemblies located near the upper and lower end regions, respectively, and at least one central bearing assembly located between the upper and lower bearing assemblies, with each of the upper, lower and central bearing assemblies having a stamped steel cover that houses a plastic liner, with at least two of the stamped steel covers differing one from another in configuration, and with the plastic liners housed by all of the steel covers being identical one with another;

c) means for pivoting the lock rod about the imaginary central axis;

d) latch member means including upper and lower cam-type latch members for being connected to the upper and lower end regions, respectively;

e) keeper means adapted to be affixed to the top and bottom portions of the frame at locations that are adjacent the upper and lower latch members when the door is closed for receiving the upper and lower latch members to secure the door closed; and, f) wherein the bearing covers that differ one from another in configuration require differing arrays of bolt-type fasteners to mount these bearing covers on the door, and each of the bearing liners is provided with a sufficient number of correspondingly arranged bolt holes to accommodate bolt-type fasteners arranged in any of the differing arrays.

32. The door control mechanism of claim 31 wherein the bearing liners each include a pair of interfitting plastic components that cooperate to define curved surface portions configured to engage a majority of the circumference of the lock rod to smoothly journal the lock rod for pivotal movement relative to the door.

33. The door control mechanism of claim 31 additionally including:

a) a tubular steel sleeve encircling and being secured to the tubular lock rod at a location between the upper end region and the lower end region, and defining upper and lower end surfaces; and, b) with the lower and central bearing assemblies sandwiching the sleeve such that the stamped steel covers of the lower and central bearing assemblies engage the lower and upper end surfaces of the sleeve to prevent axial movement of the lock rod relative to the door.

34. The door control mechanism of claim 33 wherein the lock rod is formed by two lengths of steel tubing arranged end-to-end to form a juncture therebetween, and the tubular sleeve bridges the juncture and is connected by a welding process to each of the two lengths of tubing.

* * * * *